US011359836B2

(12) United States Patent
Kanagala

(10) Patent No.: US 11,359,836 B2
(45) Date of Patent: Jun. 14, 2022

(54) HEAT EXCHANGERS PROVIDING LOW PRESSURE DROP

(71) Applicant: Rheem Manufacturing Company, Atlanta, GA (US)

(72) Inventor: Hari Krishna Kanagala, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 16/984,672

(22) Filed: Aug. 4, 2020

(65) Prior Publication Data

US 2022/0042716 A1 Feb. 10, 2022

(51) Int. Cl.

| | |
|---|---|
| ***F28F 13/12*** | (2006.01) |
| ***F24H 1/14*** | (2022.01) |
| ***F24H 1/10*** | (2022.01) |
| ***F28D 1/047*** | (2006.01) |
| *F28D 1/02* | (2006.01) |

(52) U.S. Cl.

CPC ..... *F24H 1/145* (2013.01); *F24H 1/107* (2013.01); *F28D 1/0475* (2013.01); *F28D 2001/0266* (2013.01)

(58) Field of Classification Search

CPC ..... F28F 1/14; F28F 3/14; F28F 1/00; F28F 3/02; F28F 3/12; F28D 1/06; F28D 9/0081; F28D 1/0475; F24H 3/00; F24H 3/12; F24H 1/107; F24H 1/145; F24H 1/14; F22B 21/22; F22B 21/24; F22B 21/30

See application file for complete search history.

(56) References Cited

U.S. PATENT DOCUMENTS 250,642 A * 12/1881 Brott ..... F22B 21/30 122/276
514,338 A * 2/1894 Row ..... F28F 1/022 165/177
1,922,838 A * 8/1933 Bossart ..... F28F 1/08 165/177

(Continued)

FOREIGN PATENT DOCUMENTS

GB 1038967 A * 8/1966 ..... F22B 21/22
RU 2339890 C2 11/2008

(Continued)

OTHER PUBLICATIONS

International Search Report and Written Opinion for PCT Application No. PCT/US2021/044283 dated Oct. 14, 2021.

*Primary Examiner* — Gregory A Wilson
(74) *Attorney, Agent, or Firm* — Eversheds Sutherland (US) LLP

(57) ABSTRACT

A heat exchanger having a first heat exchanger tube and a second heat exchanger tube is disclosed. The first heat exchanger tube can have a first leg, a second leg, and a bend section, and the bend section of the first heat exchanger tube can include three or more bends, each of the three or more bends having a corresponding bend angle that is less than or equal to approximately 90 degrees. The second heat exchanger tube can have a first leg, a second leg, and a bend section, and the bend section of the second heat exchanger tube can include three or more bends, each of the three or more bends having a corresponding bend angle that is less than or equal to approximately 90 degrees.

19 Claims, 14 Drawing Sheets

(56) References Cited

U.S. PATENT DOCUMENTS 3,139,867 A * 7/1964 Cleaver ..... F22B 21/24 122/406.1
4,332,236 A * 6/1982 Stora ..... F24C 15/003 126/152 B
4,612,879 A * 9/1986 Cooke ..... F22B 7/10 122/135.1
4,993,368 A * 2/1991 Jones ..... F22B 21/24 122/235.23
5,050,542 A * 9/1991 Cooke ..... F22B 21/24 122/235.23
5,839,505 A * 11/1998 Ludwig ..... F28F 13/08 165/109.1
5,870,976 A * 2/1999 Cooke ..... F22B 21/002 122/347
6,006,741 A * 12/1999 Daddis, Jr. ..... F24H 8/00 126/110 R
6,009,936 A * 1/2000 Kubota ..... F28F 1/12 165/181
6,422,306 B1 * 7/2002 Tomlinson ..... F28D 1/035 165/170
6,543,215 B2 * 4/2003 Langenfeld ..... F02G 1/043 60/39.6
6,945,320 B2 * 9/2005 Harvard, Jr. ..... F24H 3/087 126/110 R
7,255,157 B2 * 8/2007 Richardson ..... F28F 13/12 165/163
9,476,646 B2 10/2016 Soudier
10,077,956 B2 * 9/2018 Anwar ..... F28F 1/10
10,107,569 B2 * 10/2018 Choi ..... F28D 7/06
10,145,621 B2 * 12/2018 Anderson ..... F28F 1/00
10,502,368 B2 * 12/2019 Romocki ..... F28D 1/0213
2009/0064945 A1 * 3/2009 Amada ..... F24H 1/43 122/15.1
2012/0125311 A1 5/2012 Grammens et al.
2013/0240177 A1 * 9/2013 Howard ..... F28F 9/0131 165/104.11
2016/0102926 A1 * 4/2016 Polonsky ..... F28D 7/085 165/110
2016/0281532 A1 * 9/2016 Rambo ..... F01D 25/12
2020/0318911 A1 * 10/2020 Shabtay ..... F28D 1/0477

FOREIGN PATENT DOCUMENTS

WO 2009/130983 A1 10/2009
WO 2016/023209 A1 2/2016

* cited by examiner

HEAT EXCHANGERS PROVIDING LOW PRESSURE DROP

BACKGROUND

Heat exchangers are widely used to transfer heat from one fluid to another. Typically, to heat or cool a target fluid, the target fluid is passed through the heat exchanger, and within the heat exchanger is an array of heat exchanger tubes. To enhance heat transfer efficiency, fins are often installed along the heat exchanger tubes. A temperature-controlled fluid is passed through the heat exchanger tubes, and heat can thus be transferred between the target fluid and the temperature-controlled fluid via the heat exchanger tubes and the fins.

As a more specific example, gas furnaces can be used to provide heated air for a building. An air and fuel mixture is combusted, and hot combustion gases are routed through the heat exchanger tubes of the gas furnace's heat exchanger. A blower or fan can be used to force air to move across the heat exchanger, at which time heat is transferred from the hot combustion gases to the heat exchanger tubes and/or fins and from the heat exchanger tubes and/or fins to the passing air.

Recently, there has been an increase in demand for furnaces and other heat exchanging systems that have a decreased size and/or footprint. For example, there has been an increased demand for compact commercial rooftop gas furnaces.

Further, there is widespread demand for increased efficiency in furnaces and other heat exchanging systems. Unfortunately, traditional heat exchanger systems, and particularly those using traditional U-bend heat exchanger tubes, cause a large decrease in the pressure of the air passing over the heat exchanger. This can require larger blowers and/or fans, which can increase the overall cost of the system and can also decrease the overall efficiency of the system.

SUMMARY

These and other problems are addressed by the technologies described herein. Examples of the present disclosure relate generally to heat exchangers of heating, ventilation and air conditioning (HVAC) systems and, more specifically, to the configurations and arrangements of heat exchanger tubes for heat exchangers of HVAC systems.

The disclosed technology includes a heat exchanger that can include a first heat exchanger tube and a second heat exchanger tube. The first heat exchanger tube can include a first leg, a second leg, and a bend section. The bend section of the first heat exchanger tube can include three or more bends, and each of the three or more bends can have a corresponding angle (i.e., the degree of the corresponding bend, which can also be referred to as the "bend angle") that is less than or equal to approximately 90 degrees. The second heat exchanger tube can include a first leg, a second leg, and a bend section. The bend section of the second heat exchanger tube can include three or more bends, and each of the three or more bends can have a corresponding angle that is less than or equal to approximately 90 degrees.

The three or more bends of the first heat exchanger tube can include a first bend having an angle of approximately 90 degrees, a second bend having a first acute angle, and a third bend having a second acute angle. The three or more bends of the second heat exchanger tube can include a first bend having an angle of approximately 90 degrees, a second bend having a first acute angle, and a third bend having a second acute angle.

The bend section of the first heat exchanger tube can include at least one substantially straight portion, and/or the bend section of the second heat exchanger tube can include at least one substantially straight portion.

The bend section of the first heat exchanger tube can include (i) a first substantially straight portion disposed between a first bend of the three or more bends and a second bend of the three or more bends and (ii) a second substantially straight portion disposed between the second bend of the three or more bends and a third bend of the three or more bends. The bend section of the second heat exchanger tube can include (i) a first substantially straight portion disposed between a first bend of the three or more bends and a second bend of the three or more bends and (ii) second substantially straight portion disposed between the second bend of the three or more bends and a third bend of the three or more bends.

The first leg of the first heat exchanger tube can be located at a height that is greater than a height of the second leg of the first heat exchanger tube, and the second leg of the second heat exchanger tube can be located at a height that is greater than a height of the first leg of the second heat exchanger tube.

Fins can be disposed along at least a portion of the first leg of the first heat exchanger tube and at least a portion of the second leg of the second heat exchanger tube.

Ridges can be disposed along at least a portion of the first leg of the first heat exchanger tube and at least a portion of the second leg of the second heat exchanger tube.

A length of the first leg of the first heat exchanger tube can be greater than a length of the second leg of the first heat exchanger tube, and a length of the second leg of the second heat exchanger tube can be greater than a length of the first leg of the second heat exchanger tube.

At least one of the first heat exchanger tube and the second heat exchanger tube can have a non-zero incline angle with respect to horizontal when viewed from a side of the first heat exchanger tube or the second heat exchanger tube.

The incline angle can be in a range between approximately 0.5 degree and approximately 5 degrees.

The incline angle of the first heat exchanger tube can be different from the incline angle of the second heat exchanger tube.

At least one of the first heat exchanger tube and the second heat exchanger tube can have a non-zero tilt angle with respect to vertical when viewed from an end of the first heat exchanger tube or the second heat exchanger tube.

The tilt angle can be in a range between approximately 0.5 degree and approximately 10 degrees.

The tilt angle of the first heat exchanger tube can be different from the tilt angle of the second heat exchanger tube.

The first heat exchanger tube can be one of a first plurality of heat exchanger tubes, and the second heat exchanger tube can be one of a second plurality of heat exchanger tubes. Each of the first plurality of heat exchanger tubes can be located such that none of the first plurality of heat exchanger tubes is adjacent to another of the first plurality of heat exchanger tubes. Each of the second plurality of heat exchanger tubes can be located such that none of the second plurality of heat exchanger tubes is adjacent to another of the second plurality of heat exchanger tubes.

The first heat exchanger tube can be one of a first plurality of heat exchanger tubes, and the second heat exchanger tube can be one of a second plurality of heat exchanger tubes. A U-bend heat exchanger tube can be disposed between each of the first plurality of heat exchanger tubes and the second plurality of heat exchanger tubes such that each of the first plurality of heat exchanger tubes is adjacent to at least one U-bend heat exchanger tube and each of the second plurality of heat exchanger tubes is adjacent to at least one U-bend heat exchanger tube.

The first heat exchanger tube and the second heat exchanger tube can be two of a plurality of heat exchanger tubes, and the plurality of heat exchanger tubes can be configured to redirect a substantial portion of an airflow from a generally vertical direction to a generally horizontal direction.

The first heat exchanger tube can be located at a height that is greater than a height of the second heat exchanger tube.

This disclosed technology includes a furnace include the heat exchanger.

The furnace can include a combustion chamber, a combustion blower configured to move combustion gases from the combustion chamber through the first heat exchanger tube and the second heat exchanger tube, and an indoor blower configured to move air toward the first heat exchanger tube and the second heat exchanger tube.

Further features of the disclosed design, and the advantages offered thereby, are explained in greater detail hereinafter with reference to specific examples illustrated in the accompanying drawings, wherein like elements are indicated be like reference designators.

BRIEF DESCRIPTION OF THE DRAWINGS

Reference will now be made to the accompanying drawings, which are not necessarily drawn to scale, are incorporated into, and constitute a portion of, this disclosure, illustrate various implementations and aspects of the disclosed technology and, together with the description, serve to explain the principles of the disclosed technology.

FIG. 2A illustrates a three-dimensional model of the example heat exchanger, and FIG. 2B illustrates a line drawing of the example heat exchanger.

FIG. 4A illustrates a three-dimensional model of the example heat exchanger, and FIG. 4B illustrates a line drawing of the example heat exchanger.

FIG. 6A illustrates a three-dimensional model of the example heat exchanger, and FIG. 6B illustrates a line drawing of the example heat exchanger.

FIG. 7A illustrates a three-dimensional model of the example heat exchanger, and FIG. 7B illustrates a line drawing of the example heat exchanger.

FIG. 9A illustrates a three-dimensional model of the example heat exchanger, and FIG. 9B illustrates a line drawing of the example heat exchanger.

DETAILED DESCRIPTION

Figure 1:
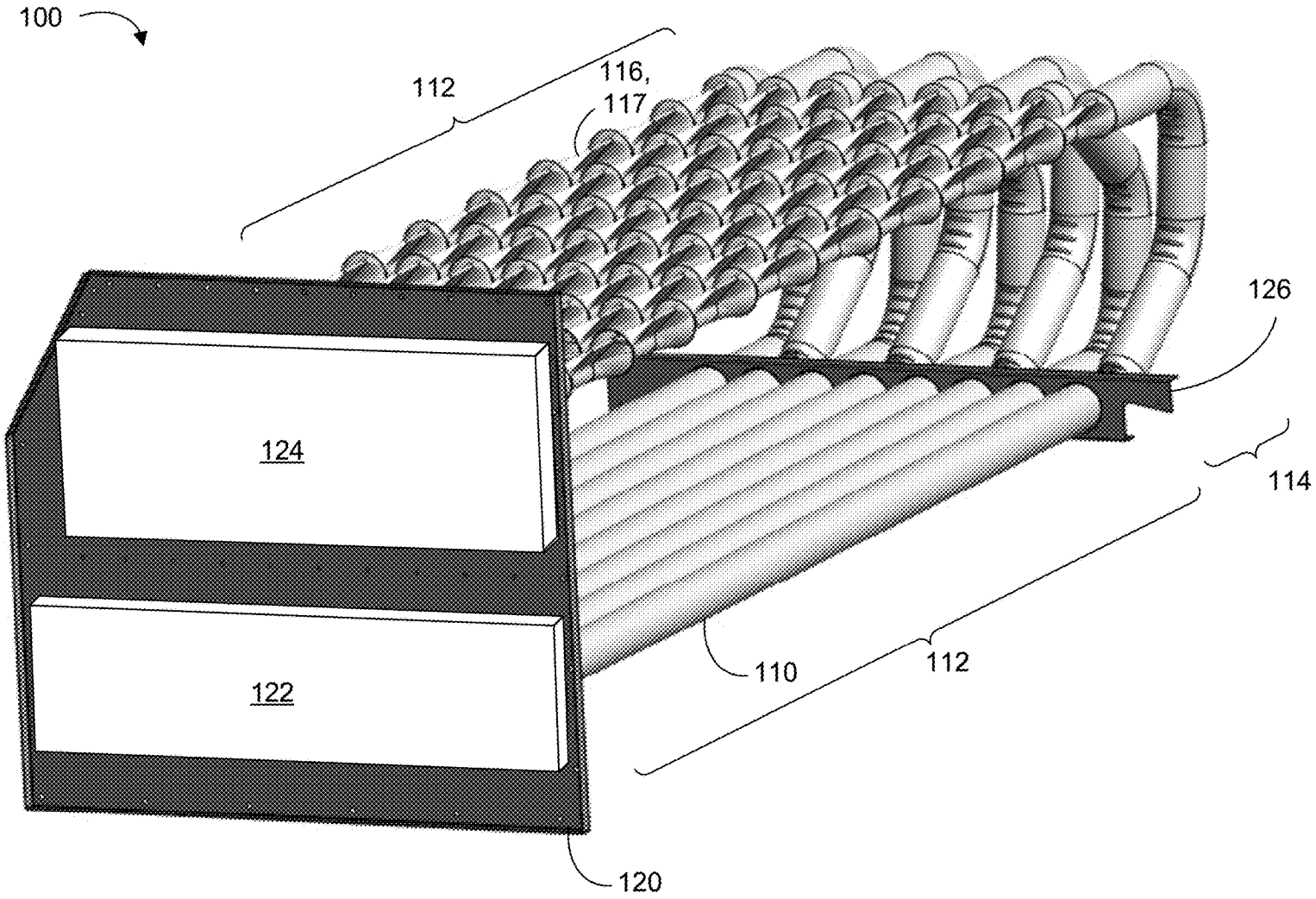
FIG. 1 illustrates a perspective view of an example heat exchanger, in accordance with the disclosed technology.

Throughout this disclosure, systems and methods are described with respect to heat exchangers that provide a low pressure drop of air flowing across the heat exchanger. The disclosed heat exchangers can be included in heating, ventilation and air conditioning (HVAC) systems. In particular, the disclosed heat exchangers can be included in gas furnaces, although one having skill in the art will recognize that the disclosed technology can be applicable to multiple scenarios and applications.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Indeed, it is to be understood that other examples are contemplated. Many suitable components that would perform the same or similar functions as components described herein are intended to be embraced within the scope of the disclosed electronic devices and methods. Such other components not described herein may include, but are not limited to, for example, components developed after development of the disclosed technology.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

Although the disclosed technology may be described herein with respect to various systems and methods, it is contemplated that embodiments or implementations of the disclosed technology with identical or substantially similar features may alternatively be implemented as methods or systems. For example, any aspects, elements, features, or the like described herein with respect to a method can be equally attributable to a system. As another example, any aspects, elements, features, or the like described herein with respect to a system can be equally attributable to a method.

Reference will now be made in detail to example embodiments of the disclosed technology, examples of which are illustrated in the accompanying drawings and disclosed herein. Wherever convenient, the same reference numbers will be used throughout the drawings to refer to the same or like parts.

The disclosed technology relates generally to heat exchangers for HVAC systems. In particular, certain aspects of the disclosed technology relate to the structure and arrangement of heat exchanger tubes in a heat exchanger. For example, the disclosed technology can be used in a furnace in which air is run across heat exchanger tubes of a heat exchanger to transfer heat from hot combustion gases flowing within the heat exchanger tubes to the passing air. As will be appreciated, furnaces (e.g., gas-fired furnaces) are but one application in which the disclosed technology can be used. Other systems and devices using a heat exchanger can include the disclosed technology. Further, in place of hot combustion gases, the fluid flowing within the heat exchanger tubes can include water, one or more refrigerants, other gases, or any other fluid from which heat can be imparted to a fluid passing through the heat exchanger and along the exterior of the heat exchanger tubes.

As explained above, traditional heat exchangers can cause a pressure decrease (commonly referred to as a "pressure drop") in a target fluid as the target fluid is moved across the heat exchanger. As an example, such a pressure drop can be prevalent in a furnace of an HVAC system. Further, there can be market pressures to provide assemblies (e.g., furnaces) that are compact, and the compactness of certain assemblies can contribute to the undesirable pressure drop of the target fluid.

Further, certain heat exchangers are designed to receive airflow in a first direction and redirect the airflow (or a substantial portion of the airflow) into a second direction that is approximately 90 degrees relative the first direction (see, e.g., FIG. 9). For ease of discussion, the first direction can be referred to as down-flow, and the second direction can be referred to as side-flow. Moreover, the arrangement and configuration of heat exchanger tubes can be such that the heat exchanger has a high aspect ratio. That is, heat exchangers tend to have a length that is greater than its height. This difference in length and height can translate into difference in cross sectional areas for the circulating airflow between side-flow and downflow directions, contributing to the difference in the overall pressure drop across the heat exchanger.

In traditional systems, U-bend heat exchanger tubes are generally used. The U-bend tubes generally have a bend section that has semi-circular bend, and the semi-circular bend often has constant radius. Alternatively, traditional U-bend tubes can have two bends of approximately 90 degrees, and the two bends can be connected by a length of straight tube. The relatively small spaces between the adjacent tubes can form a sort of wall or barrier, causing high pressure drop. To overcome the decrease in pressure caused by the tubes, it is commonplace to use a blower, fan, or other air movement device that is larger and powerful than otherwise necessary. Stated otherwise, existing systems typically require excessive energy consumption to compensate for the pressure drop created by existing heat exchanger designs.

As explained more fully herein, such pressure drop can be reduced by increasing the amount of open area between the heat exchanger tubes at the bend sections of the tubes.

Referring to FIG. 1, a heat exchanger 100 can include an arrangement of heat exchanger tubes 110. The heat exchanger tubes 110 can be substantially hollow such that fluid can flow from an inlet of a given heat exchanger tube 110 to an outlet of the given heat exchanger tube 110. As will be described in more detail below, the heat exchanger tubes 110 can include multiple designs and/or configurations, which can include a first heat exchanger tube 110A and a second heat exchanger tube 110B. Regardless of the particular design and/or configuration, each heat exchanger tube 110 can include two legs 112 (also referenced herein as straight sections 112) and a bend section 114. The legs or straight sections 112 can be substantially parallel and can be connected via the bend section 114. The overall length of the first and second heat exchanger tubes 110A, 110B can be the same. Alternatively, the overall length of the first heat exchanger tube 110A can be greater than the overall length of the second heat exchanger tube 110B, or vice versa. The top straight section 112 (when installed in the heat exchanger 100) can include fins 116, ridges 117, and/or certain geometries to improve heat transfer, such as is disclosed by U.S. Pat. No. 10,415,892, the contents of are incorporated in their entirety as if fully set forth herein.

Figure 2A:
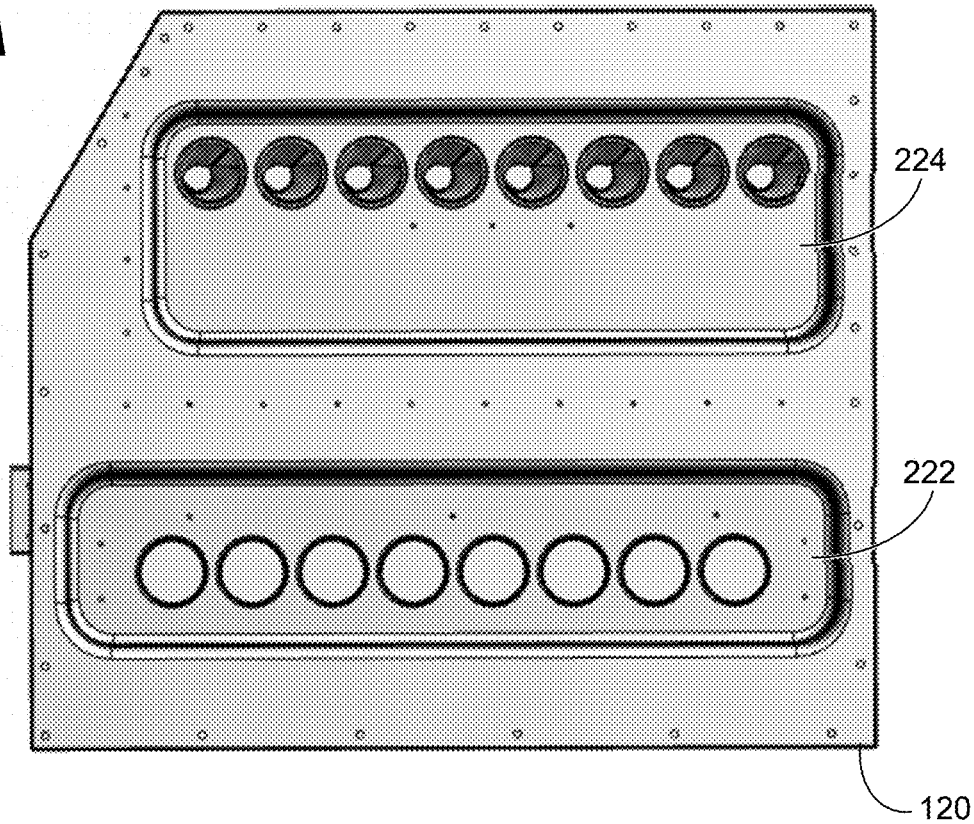
FIGS. 2A and 2B each illustrate an end view of an example heat exchanger, in accordance with the disclosed technology.
Figure 2B:
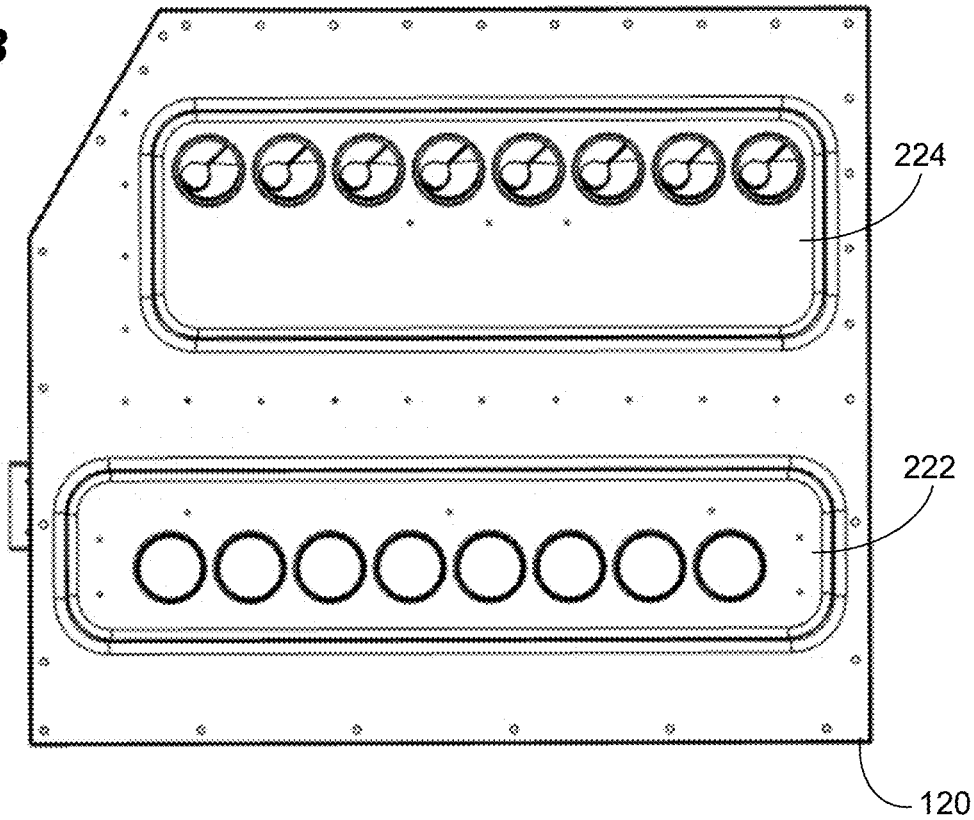

The heat exchanger 100 can include a tube plate 120 configured to maintain the heat exchanger tubes 110 in a desired configuration. The tube plate 120 can include an aperture for each open end of a heat exchanger tube 110 (e.g., as shown in FIGS. 2A and 2B) such that fluid communication is facilitated between the interior of each heat exchanger tube 110 and other components of the heat exchanger 100 and/or a corresponding furnace or other heat transfer assembly. As an example, the interior of each heat exchanger tube 110 can be in fluid communication with an inlet assembly 122 of the heat exchanger 100 via ingress apertures of the tube plate 120, and the inlet 122 can be configured to receive combustion gases or another fluid for transferring heat. For example, in the case of a furnace, the inlet 122 can be configured to receive combustion gases from a combustion chamber in which an air/fuel mixture is combusted. The heat exchanger tubes 110 can be in fluid communication with a blower assembly 124 (e.g., an induction blower), which can be configured to draw the hot combustion gases from a combustion chamber or other source. That is, hot combustion gases can flow sequentially through the inlet 122 of the heat exchanger 100, through the ingress apertures of the tube plate 120, through the bottom straight section 122 of each heat exchanger tube 110, through the bend sections 114 of each heat exchanger tube 110, through the top straight section 122 of each heat exchanger tube 110, through the egress apertures of the tube plate 120, and through the blower assembly 124 to an outlet (not shown).

Figure 7A:
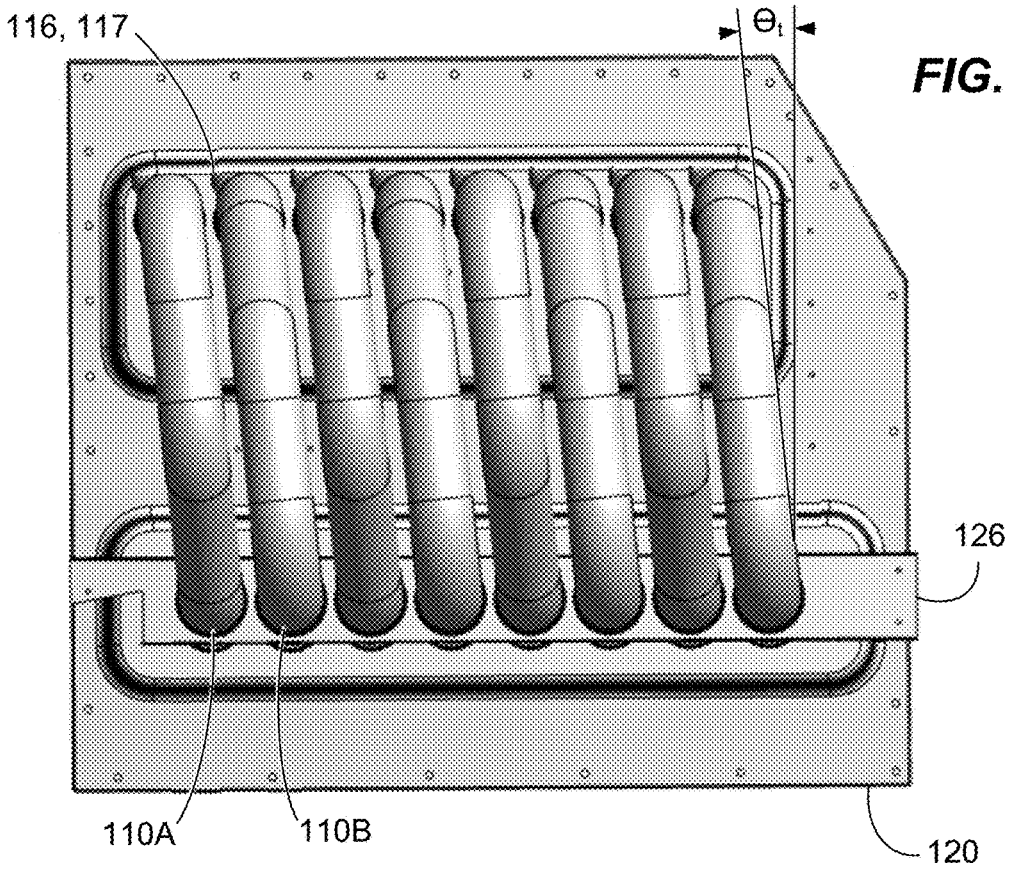
FIGS. 7A and 7B each illustrate an end view of an example heat exchanger, in accordance with the disclosed technology.
Figure 7B:
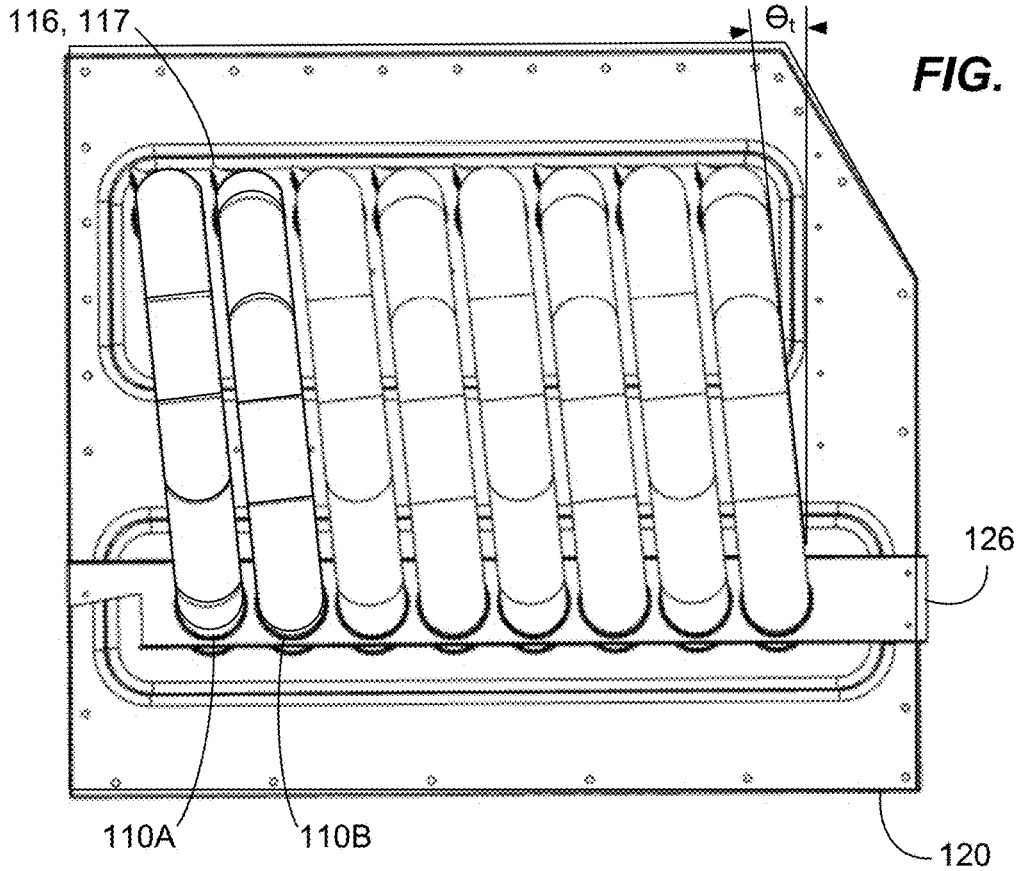

Referring to FIGS. 2A and 2B, which provide a three-dimensional model and a line drawing of the same view, the end of the tube plate 120 is shown with the blower assembly 124 and the inlet assembly 122 removed. As shown, the ingress apertures of the tube plate 120 can be in fluid communication with an ingress portion 222, and the egress apertures of the tube plate 120 can be in fluid communication with an egress portion 224. Thus, the combustion gases or other fluid can accumulate in the ingress portion 222 and become distributed into the inlet of each heat exchanger tube 110 via the ingress apertures. Conversely, the combustion gases can exit the outlet of each heat exchanger tube 110 and flow through the egress apertures, accumulating in the egress portion 224. Optionally, one, some, or all of the egress apertures can be laterally offset with respect to the ingress apertures, as shown in FIGS. 2A and 2B. This can result in the corresponding heat exchanger tube(s) 110 having a lateral tilt when installed, such as described herein with respect to FIGS. 7A and 7B in particular.

Figure 3A:
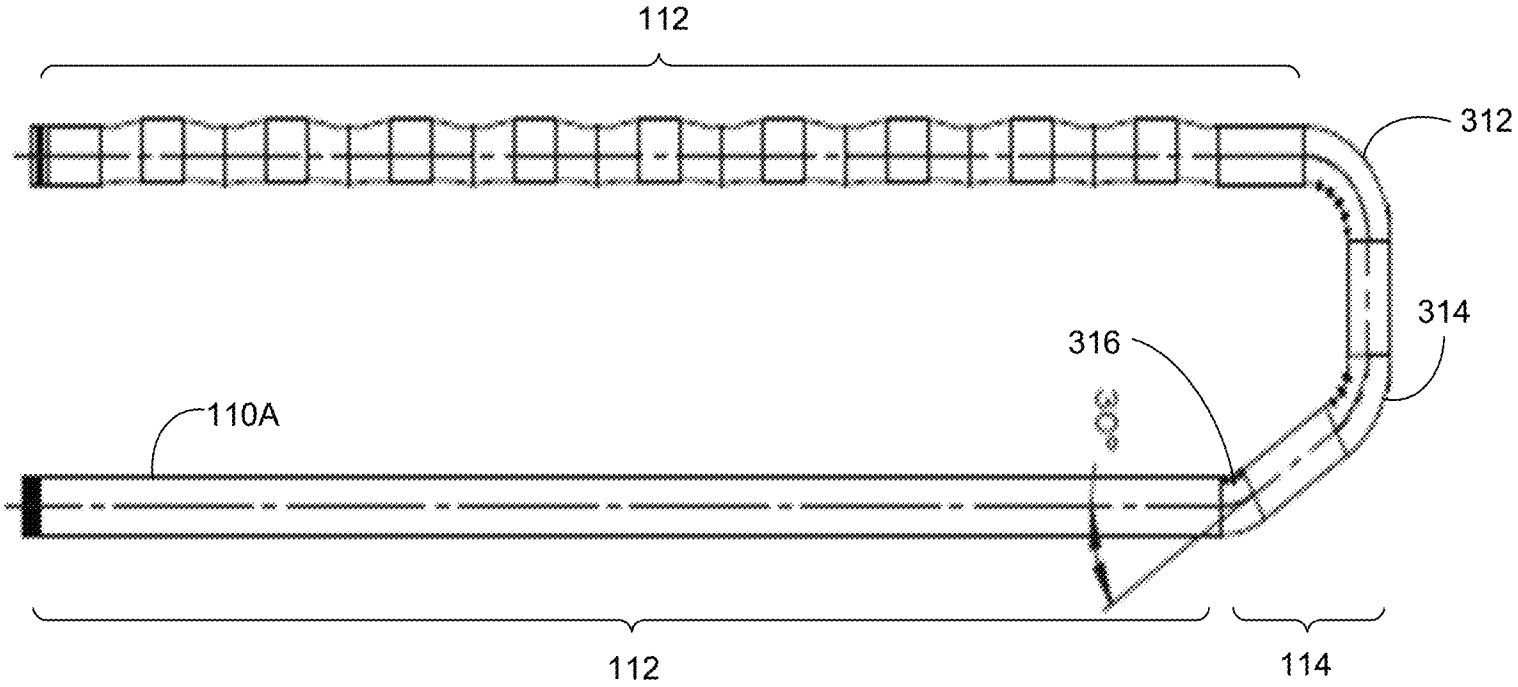
FIG. 3A illustrates a first example heat exchanger tube, in accordance with the disclosed technology.
Figure 3B:
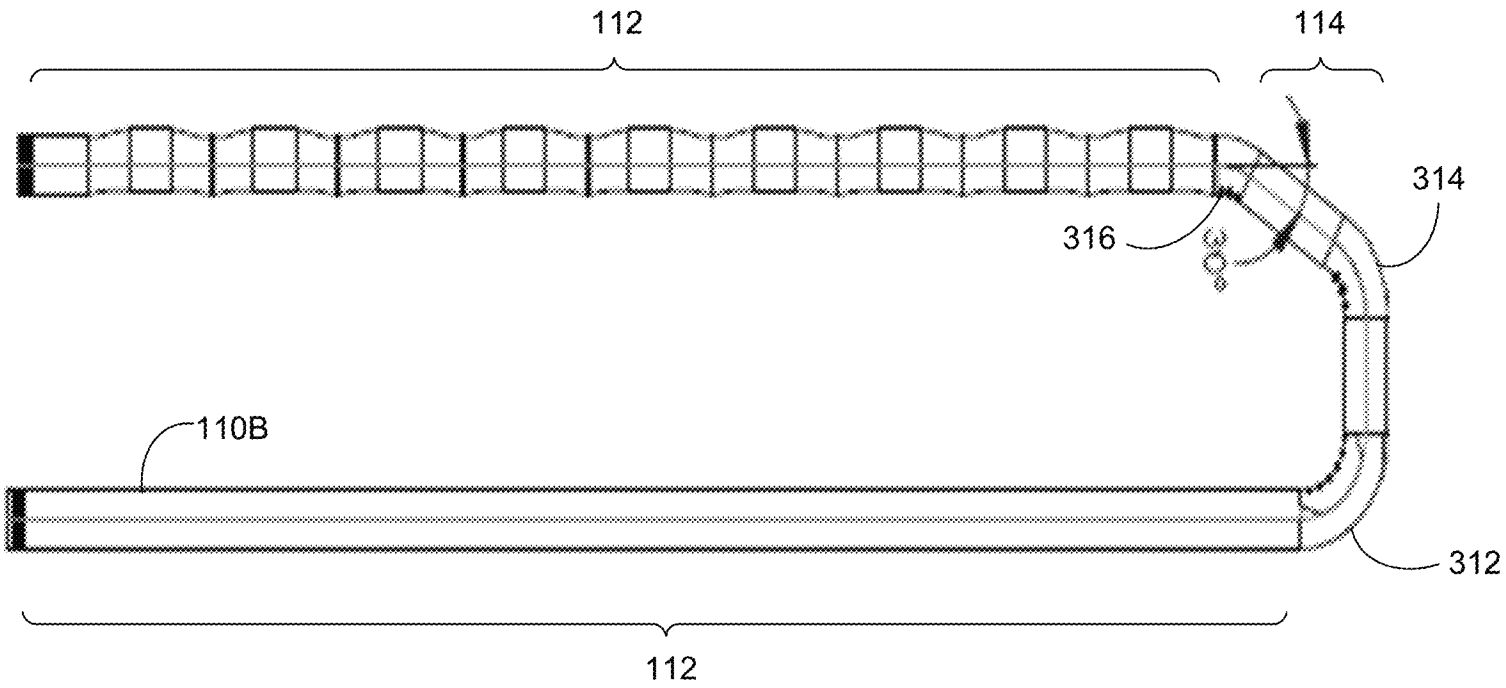
FIG. 3B illustrates a second example heat exchanger tube, in accordance with the disclosed technology.

Referring to FIGS. 3A and 3B, two different designs of heat exchanger tubes 110A, 110B are described. As can be seen, in either design, each heat exchanger tubes 110A, 110B includes two, substantially parallel straight sections 112 and a bend section 114. The straight sections 112 can be substantially straight. Each bend section 114 can include two or more bends. For example, the bend section 114 can include three or more bends, including a first bend 312, a second bend 314, and a third bend 316. Between each adjacent bend 312, 314, 316 can be disposed a straight portion of the bend section 114. For example, as illustrated by FIGS. 3A and 3B, the bend section 114 can include a first straight portion disposed between and abutting both the first bend 312 and the second bend 314 and can include a second straight portion disposed between and abutting both the second bend 314 and the third bend 316. As will be appreciated, the first heat exchanger tube 110A can include additional bends 312, 314, 316 beyond the three illustrated in FIGS. 3A and 3B. Each bend 312, 314, 316 can be separated by a straight portion. Alternatively, some of all of the bends 312, 314, 316 can abut one or more adjacent bends 312, 314, 316. That is, a given bend 312, 314, 316 can abut one or two other bends 312, 314, 316, a given bend 312, 314, 316 can abut one bend 312, 314, 316 and one straight portion, or a given bend can abut two straight portions.

Each heat exchanger tube 110 can have a bottom straight section 112 and a top straight section 112. Referring to FIG. 3A, the top straight section 112 of the first heat exchanger tube 110A can be longer than the bottom straight section 112 of the first heat exchanger tube 110A. The top straight section 112 of the first heat exchanger tube 110A can be adjacent to the first bend 312 of the bend section 114 of the first heat exchanger tube 110A. The bottom straight section 112 of the first heat exchanger tube 110A can be adjacent to the third bend 316 of the bend section 114 of the first heat exchanger tube 110A. The top straight section 112 of the first heat exchanger tube 110A can include fins 116, ridges 117, and/or certain geometries to improve heat transfer. Referring to FIG. 3B, the bottom straight section 112 of the second heat exchanger tube 110B can be longer than the top straight section 112 of the second heat exchanger tube 110B. The bottom straight section 112 of the second heat exchanger tube 110B can be adjacent to the first bend 312 of the bend section 114 of the second heat exchanger tube 110B. The top straight section 112 of the second heat exchanger tube 110B can be adjacent to the third bend 316 of the bend section 114 of the second heat exchanger tube 110B. The top straight section 112 of the second heat exchanger tube 110B can include fins 116, ridges 117, and/or certain geometries to improve heat transfer.

The first bend 312 can have an angle (i.e., the degree of the corresponding bend, which can also be referred to as the "bend angle") of approximately 90 degrees, and the remaining bends (e.g., the second bend 314 and the third bend 316) can each have an acute angle (i.e., the degree of the corresponding bend, which can also be referred to as the "bend angle") as measured from the change in the orientation of the centerline on the external side of the heat exchanger tube 110. The sum of all three bend-angles of bends 312, 314 and 316 can be equal or approximately equal to 180 degrees. This will allow the two straight legs 112 of the tube 110A, 110B to stay substantially parallel. For example, the third bend 316 can have an angle of approximately 30 degrees, as shown by FIGS. 3A and 3B. Thus, as an example, the second bend 314 can have an angle of approximately 60 degrees. As shown, the second and third bends 314, 316 can have different angles. Alternatively, the second and third bends 314, 316 can have the same angle (e.g., approximately 45 degrees). Of course, any bend (e.g., bends 314, 316) other than the first bend 312 can have any angle that is acute. For example, any bend (e.g., bends 314, 316) other than the first bend 312 can have an angle in the range between approximately 1 degree and approximately 15 degrees. As another example, any bend (e.g., bends 314, 316) other than the first bend 312 can have an angle in the range between approximately 15 degrees and approximately 30 degrees. As yet another example, any bend (e.g., bends 314, 316) other than the first bend 312 can have an angle in the range between approximately 30 degrees and approximately 45 degrees. As yet another example, any bend (e.g., bends 314, 316) other than the first bend 312 can have an angle in the range between approximately 45 degrees and approximately 60 degrees. As yet another example, any bend (e.g., bends 314, 316) other than the first bend 312 can have an angle in the range between approximately 60 degrees and approximately 75 degrees. As yet another example, any bend (e.g., bends 314, 316) other than the first bend 312 can have an angle in the range between approximately 75 degrees and approximately 89 degrees.

As shown by FIGS. 3A and 3B, the first and second heat exchanger tubes 110A, 110B can have bends 312, 314, 316 of the same corresponding angles. The first and second heat exchanger tubes 110A, 110B can have bends 312, 314, 316 of the same corresponding angles but in reverse sequential order (e.g., as shown by FIGS. 3A and 3B). Alternatively, the first heat exchanger tube 110A can have bends 312, 314, 316 having angles that are different from the angles of the corresponding bends 312, 314, 316 of the second heat exchanger tube 110B.

Figure 4A:
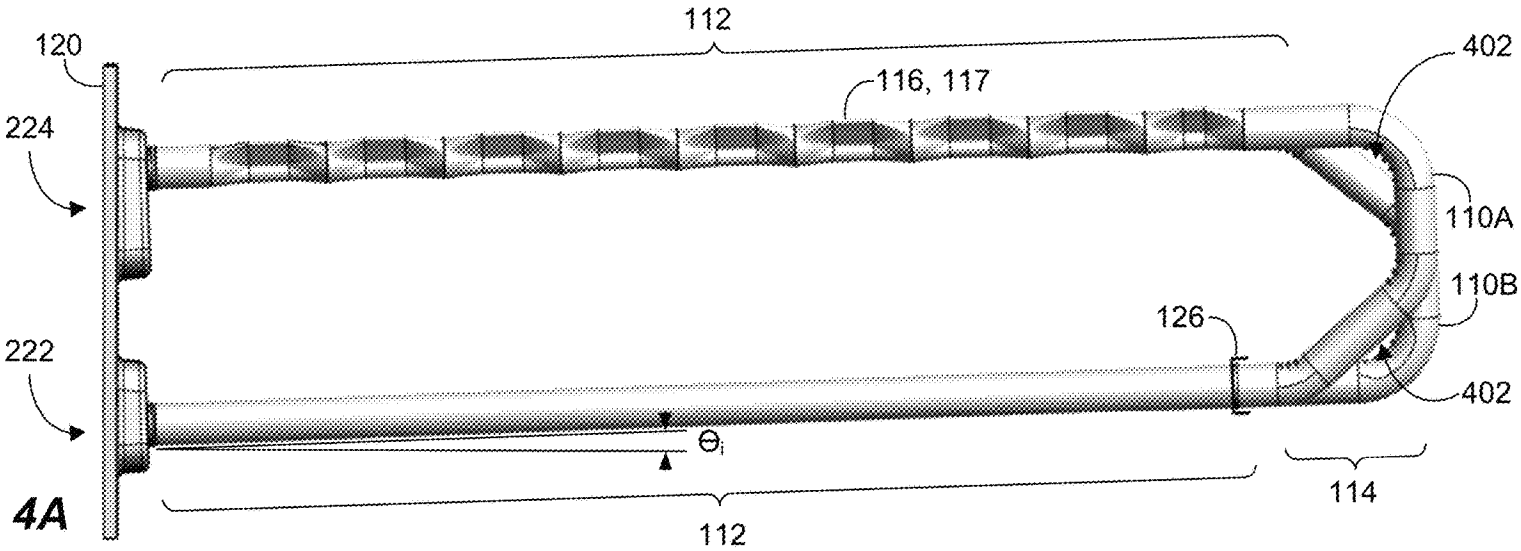
FIGS. 4A and 4B each illustrate a side view of an example heat exchanger, in accordance with the disclosed technology.
Figure 4B:
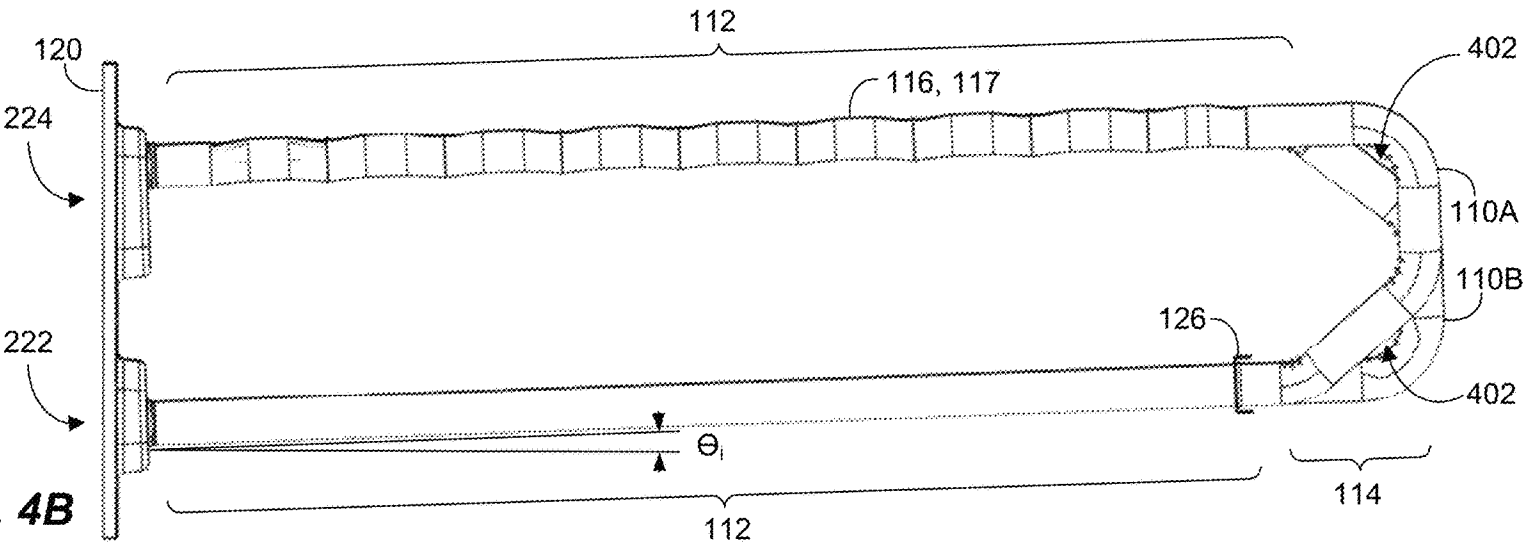

FIGS. 4A and 4B, which provide a three-dimensional model and a line drawing of the same view, illustrate a side view of multiple heat exchanger tubes 110A, 110B (collectively referenced as heat exchanger tubes 110) attached to the tube plate 120. The heat exchanger tubes 110 can be attached to the tube plate 120 such that each straight portion 112 of the heat exchanger tubes 110 and the tube plate 120 form an approximately 90 degree angle. Alternatively, the heat exchanger tubes 110 can be attached to the tube plate 120 such that each straight portion 112 of the heat exchanger tubes 110 and the tube plate 120 form a non-90 degree angle. That is, the straight portions 112 of a given heat exchanger tube 110 can each form an incline angle $\theta_i$ with respect to horizontal. The heat exchanger tube(s) 110 can form incline angle $\theta_i$ with or without the tube plate 120 being perpendicular to horizontal. The incline angle $\theta_i$ can be any angle less than 90 degrees. For example, the incline angle $\theta_i$ can be in a range between approximately 0.5 degree and approximately 5 degrees. As another example, the incline angle $\theta_i$ can be in a range between approximately 5 degrees and approximately 10 degrees. As yet another example, the incline angle $\theta_i$ can be in a range between approximately 10 degrees and approximately 15 degrees. As one particular example, the incline angle $\theta_i$ can be approximately 2 degrees. The first and second heat exchanger tubes 110 can have the same incline angle $\theta_i$. Alternatively, the incline angle $\theta_i$ of the first heat exchanger tube 110A can be different from the incline angle $\theta_i$ of the second heat exchanger tube 110B.

Figure 5:
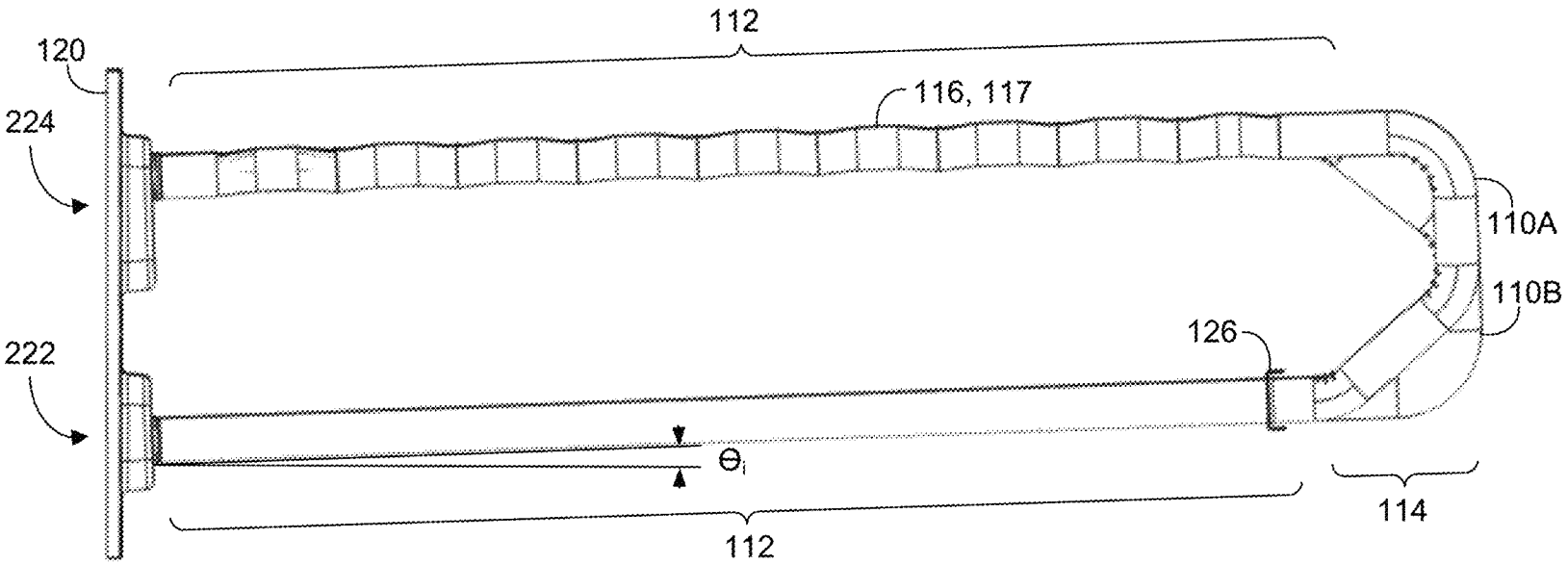
FIG. 5 illustrates a side view of another example heat exchanger, in accordance with the disclosed technology.

One or more first heat exchanger tubes 110A and one or more second heat exchanger tubes 110B can be arranged such that, when viewed from the side, one or more gaps 402 are formed between an internal edge of the bend section 114 of the first heat exchanger tube(s) 110A and an external edge of the bend section 114 of the second heat exchanger tube(s) 110B, or vice versa. The gap(s) 402 can provide additional space through which passing air or other fluid can flow, thereby helping to reduce the overall pressure drop imparted to the passing air. Alternatively, and with reference to FIG. 5, the heat exchanger tubes 110 can be arranged such that an air gap does not exist when the heat exchanger tubes 110 are viewed from the side.

Figure 6A:
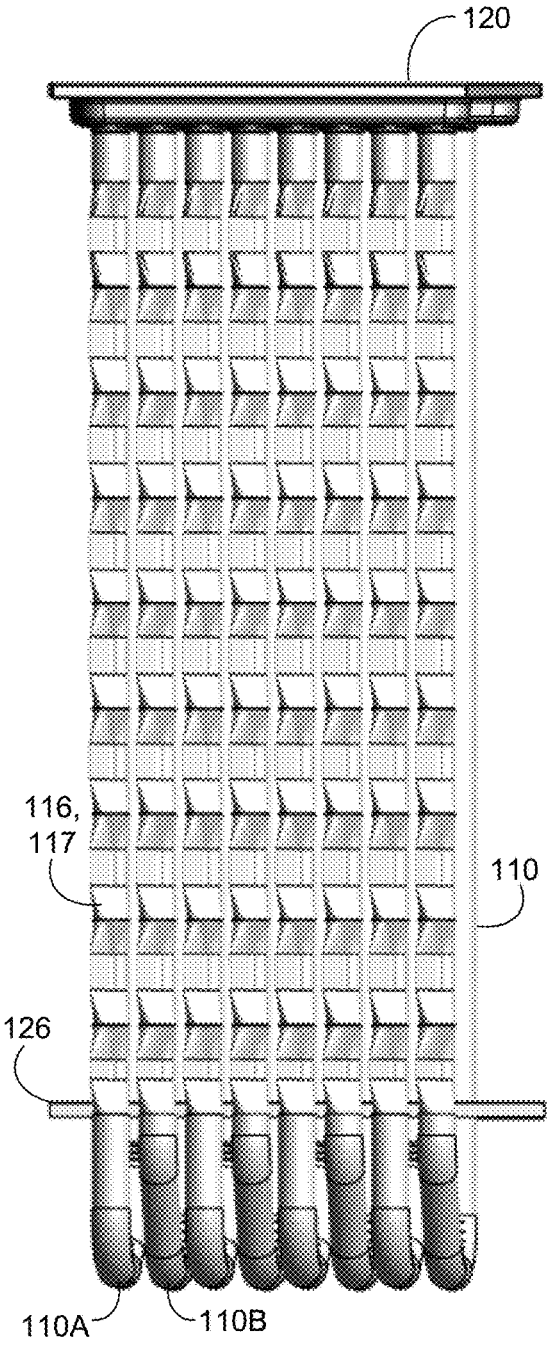
FIGS. 6A and 6B each illustrate a top view of an example heat exchanger, in accordance with the disclosed technology.
Figure 6B:
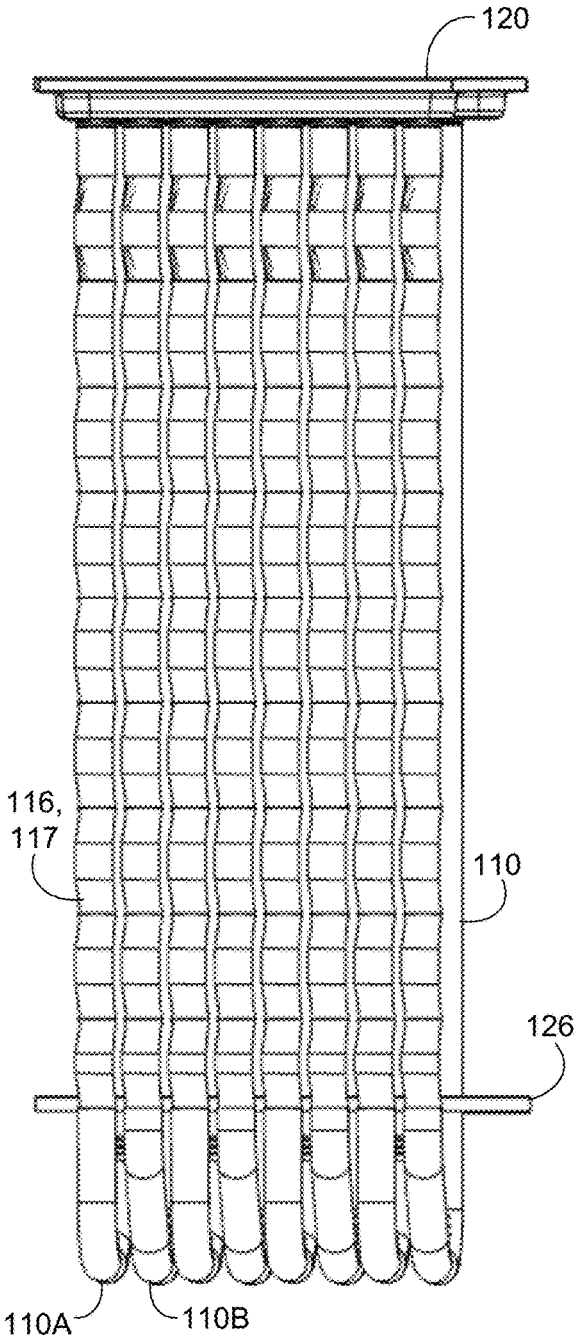

FIGS. 6A and 6B, which provide a three-dimensional model and a line drawing of the same view, illustrate a top view of multiple heat exchanger tubes 110 attached to the tube plate 120. Similarly, FIGS. 7A and 7B, which provide a three-dimensional model and a line drawing of the same view, illustrate an end view of multiple heat exchanger tubes 110 attached to the tube plate 120. As shown in FIGS. 6A-7B, and most clearly in FIGS. 7A and 7B, the heat exchanger tubes 110 can have a lateral tilt when installed. That is, a given heat exchanger tube 110 can form a tilt angle $\theta_t$ with respect to vertical. The incline angle $\theta_t$ can be any angle less than 90 degrees. For example, the tilt angle $\theta_t$ can be in a range between approximately 0.5 degree and approximately 10 degrees. As another example, the tilt angle $\theta_t$ can be in a range between approximately 20 degrees and approximately 30 degrees. As yet another example, the tilt angle $\theta_t$ can be in a range between approximately 30 degrees and approximately 45 degrees. As one particular example, the tilt angle $\theta$ can be approximately 6 degrees. The first and second heat exchanger tubes 110 can have the same tilt angle $\theta_t$. Alternatively, the tilt angle $\theta_t$ of the first heat exchanger tube 110A can be different from the tilt angle $\theta_t$ of the second heat exchanger tube 110B.

Figure 8:
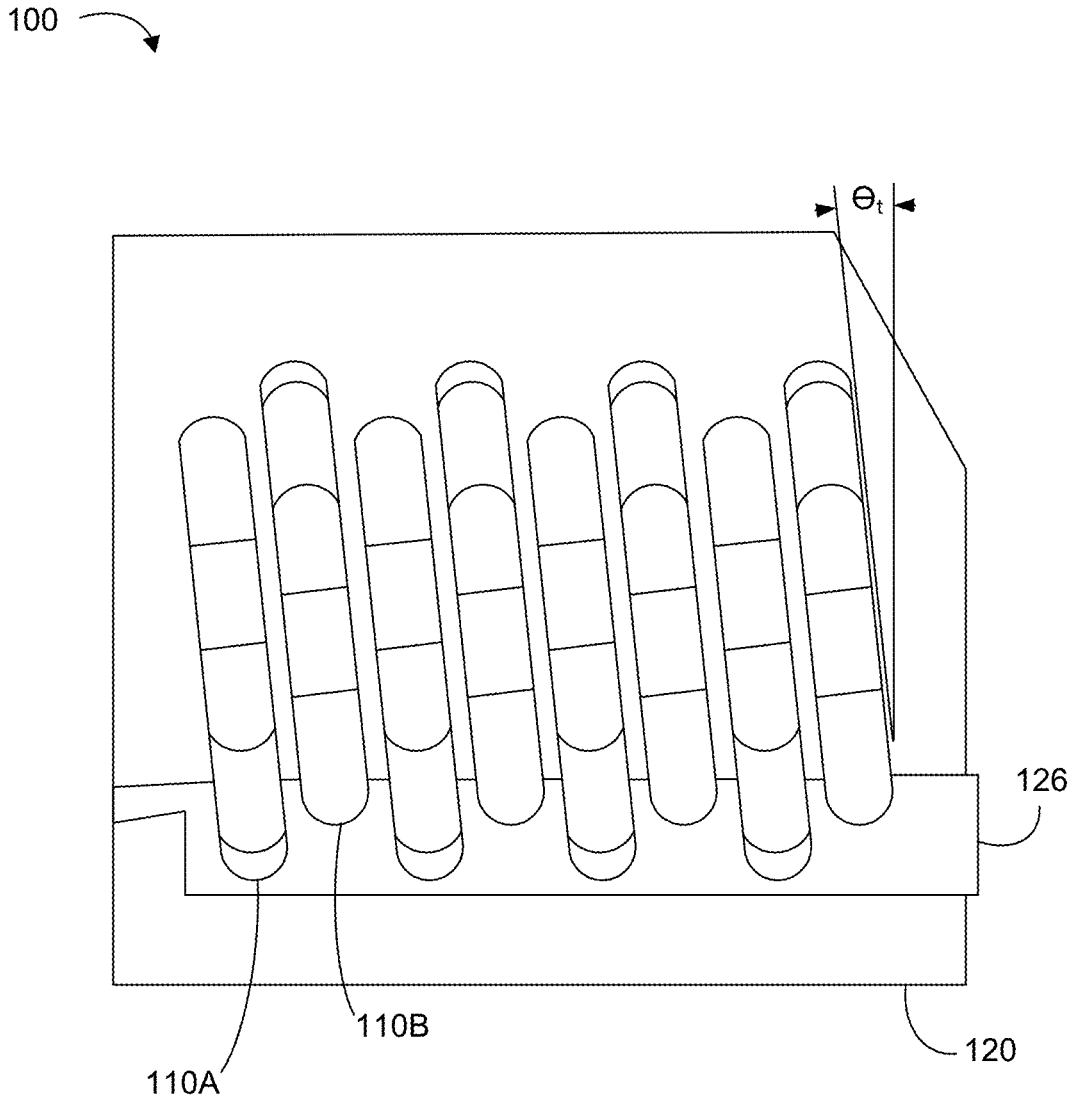
FIG. 8 illustrates an end view of another example heat exchanger, in accordance with the disclosed technology.

Alternatively or additionally, the first heat exchanger tube 110A can be vertically offset with respect to the second heat exchanger tube 110B. As shown in FIG. 8, the first heat exchanger tube 110A can be located at a height (e.g., on the tube sheet 120) that is greater than a height of the second heat exchanger tube 110B. Alternatively, the first heat exchanger tube 110A can be located at a height (e.g., on the tube sheet 120) that is less than a height of the second heat exchanger tube 110B.

Figure 9A:
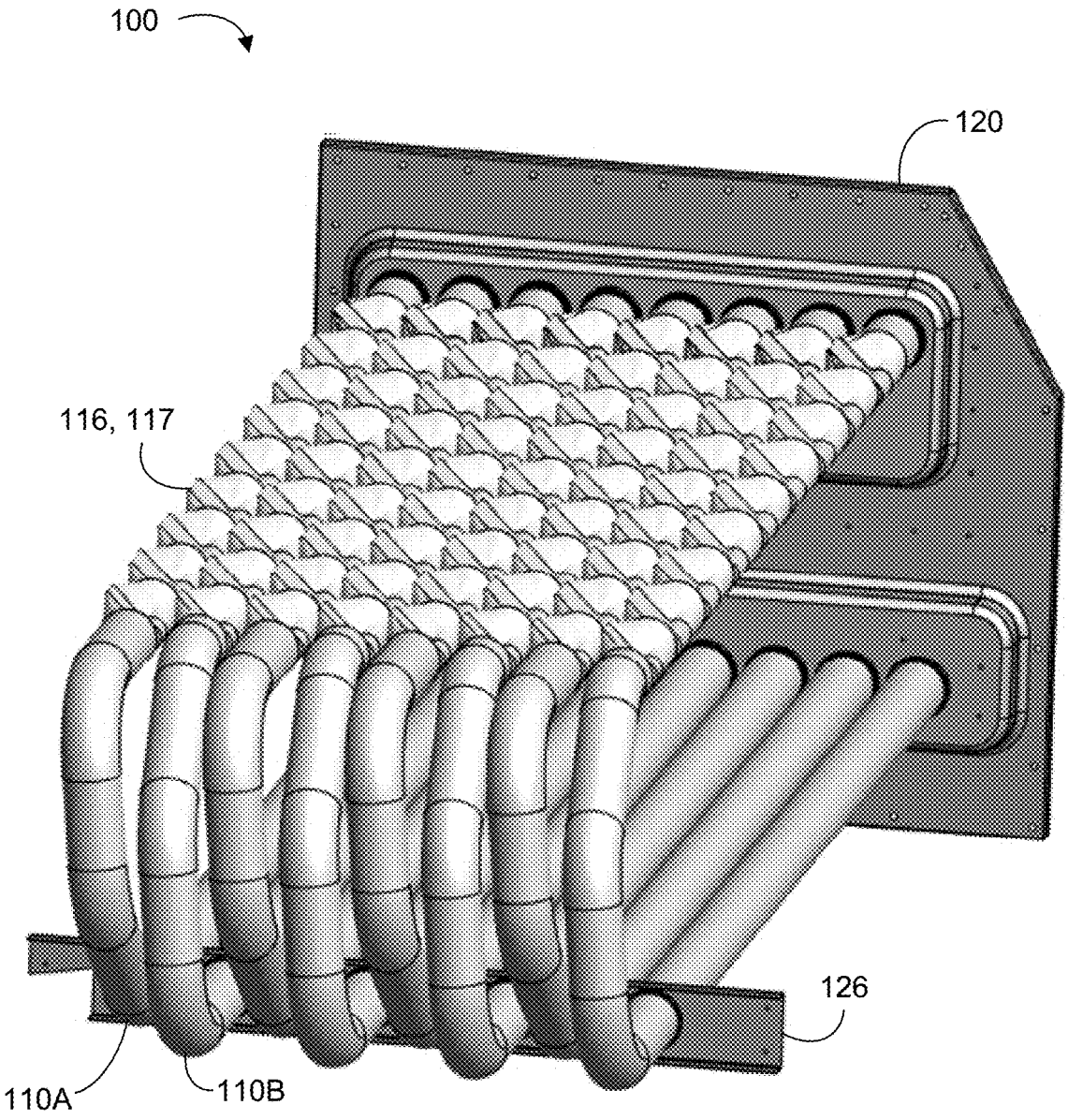
FIGS. 9A and 9B each illustrate a perspective view of an example heat exchanger, in accordance with the disclosed technology.
Figure 9B:
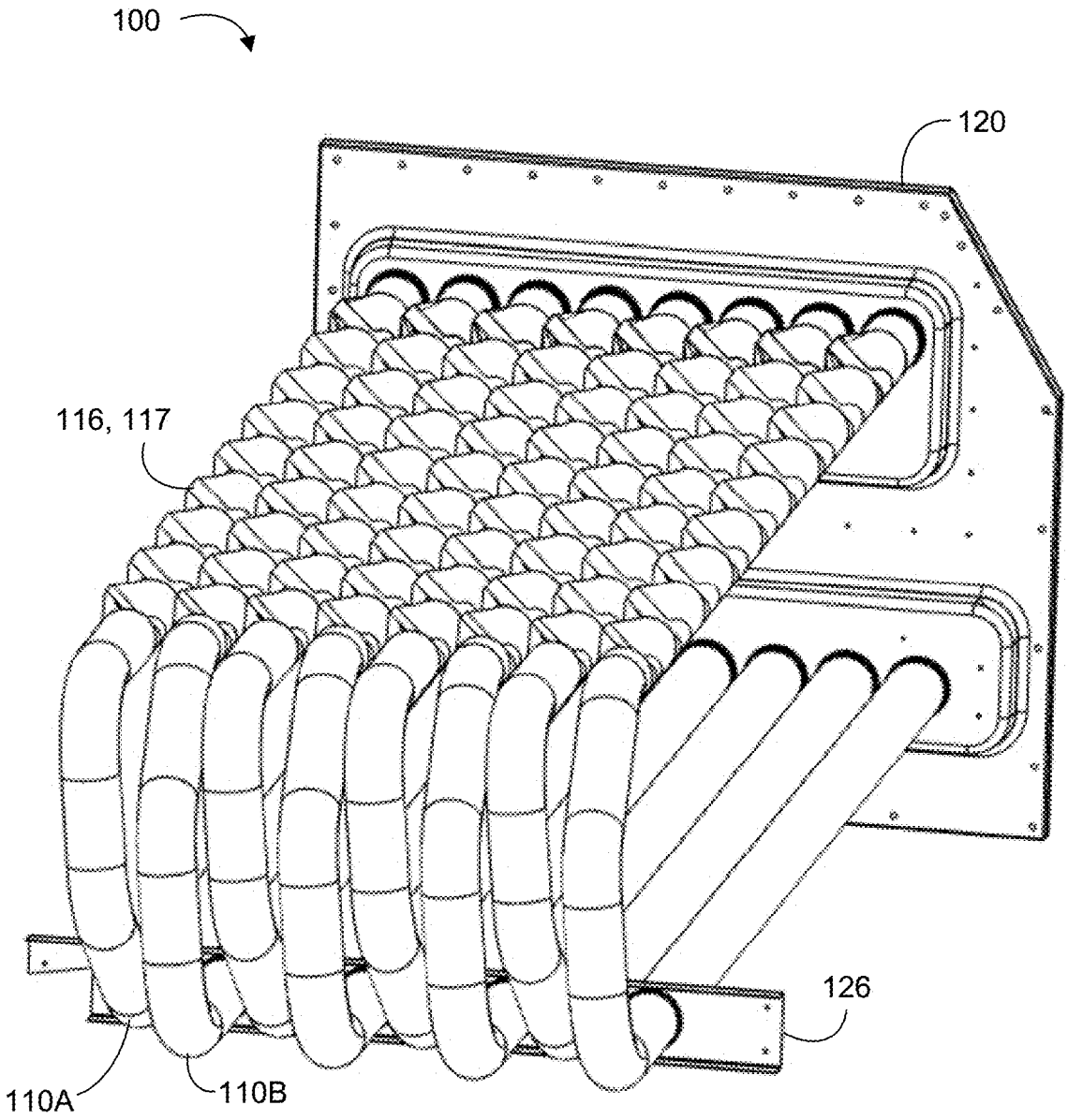
Figure 9C:
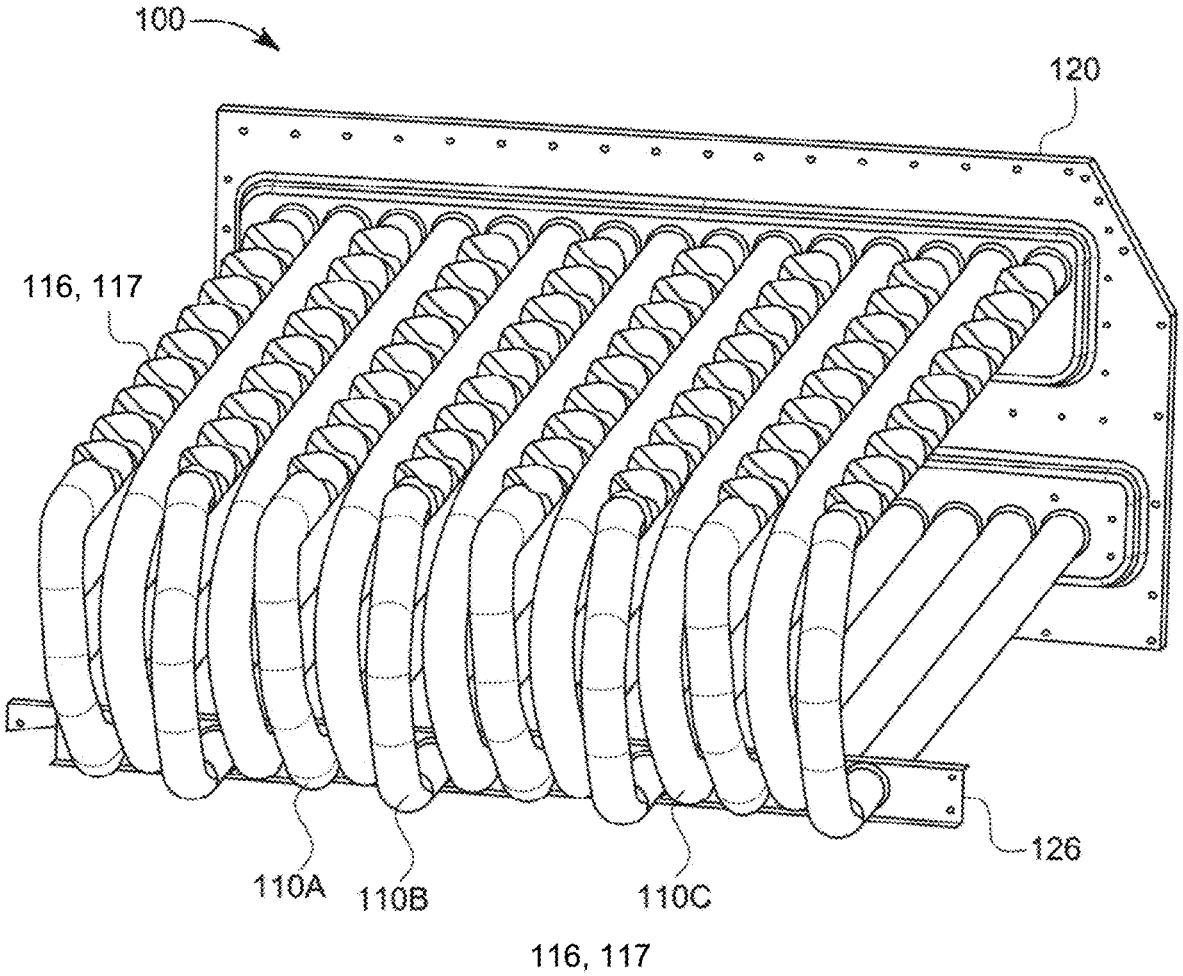
FIG. 9C illustrates an example heat exchanger, in accordance with the disclosed technology.

Referring now in particular to FIGS. 9A and 9B, which provide a three-dimensional model and a line drawing of the same view of the heat exchanger 100, the first and second heat exchanger tubes 110A, 110B can be arranged in an alternating sequence. That is, any heat exchanger tube 110 adjacent to a given first heat exchanger tube 110A can be a second heat exchanger tube 110B, and any heat exchanger tube 110 adjacent to a given second heat exchanger tube 110B can be a first heat exchanger tube 110A. The sequence can begin and/or end with a first heat exchanger tube 110A, and the sequence can begin and/or end with a second heat exchanger tube 110B. That is, the endmost tube can be either a first heat exchanger tube 110A or a second heat exchanger tube 110B.

Alternatively or additionally, the heat exchanger tubes 110 can be arranged such that two, three or more of the same type of heat exchanger tubes are sequentially ordered. For example, at least some of the heat exchanger tubes can be arranged in the following sequence: two first heat exchanger tubes 110A, two second heat exchanger tubes 110B, two first heat exchanger tubes 110A, two second heat exchanger tubes 110B.

Alternatively or additionally, the heat exchanger tubes 110 can be arranged such that the first heat exchanger tubes 110A can have bend 312, 314, 316 angles that are different from the corresponding bend 312, 314, 316 angles of the second heat exchanger tubes 110B, and vice versa. Alternatively or additionally, one or more of the first heat exchanger tubes 110A can have bend 312, 314, 316 angles that are different from the corresponding bend 312, 314, 316 angles of the other first heat exchanger tubes 110A. Alternatively or additionally, one or more of the second heat exchanger tubes 110B can have bend 312, 314, 316 angles that are different from the corresponding bend 312, 314, 316 angles of the other second heat exchanger tubes 110B.

Alternatively or additionally, the heat exchanger tubes 110 can include additional configurations of heat exchanger tubes, such as third, fourth, and/or other heat exchanger tubes 110. Each grouping of heat exchanger tubes 110 can have a design that differs from the other groupings of heat exchanger tubes 110. For example, first heat exchanger tubes 110A can be different from second heat exchanger tubes, which can be different from third heat exchanger tubes, which can be different from fourth heat exchanger tubes. As an example, one of the groupings of heat exchanger tubes can be traditional U-bend tubes.

The various groupings of heat exchanger tubes can be arranged in any desired arrangement. As an example, a traditional U-bend tube can be disposed between each tube of another grouping of heat exchanger tubes. For example, referring in particular to FIG. 9C, at least some of the heat exchanger tubes can be arranged in the following sequence: one first heat exchanger tube 110A, one U-bend tube, one second heat exchanger tube 110B, one U-bend tube. This sequence can be repeated. Other sequences not expressly described herein are contemplated.

As can be seen throughout the drawings, the first heat exchanger tube 110A is shown as not being a mirrored version of the second heat exchanger tube 110B and vice versa. Alternatively, however, the disclosed technology includes first and second heat exchanger tubes 110A, 110B that are each a mirror version of the other (e.g., mirrored along a longitudinal axis and/or flipped 180° along the longitudinal axis). For example, the first and second heat exchanger tubes can each have a shorter straight section 112, a longer straight section 112, and a bend section 114 with a first bend 312 of approximately 90 degrees and adjacent to the longer straight section and at least a second bend 314 having a first common angle and a third bend 316 having a second common angle. The mirrored first and second heat exchanger tubes 110A, 110B can omit fins 116, ridges 117, and/or certain related geometries. As mentioned above, the mirrored first and second heat exchanger tubes 110A, 110B can be mirrored along a longitudinal axis such that, for the first heat exchanger tube 110A, the longer straight section 112 is positioned above the shorter straight section 112, and for the second heat exchanger tube 110B, the shorter straight section 112 is positioned above the longer straight section 112.

Figure 10:
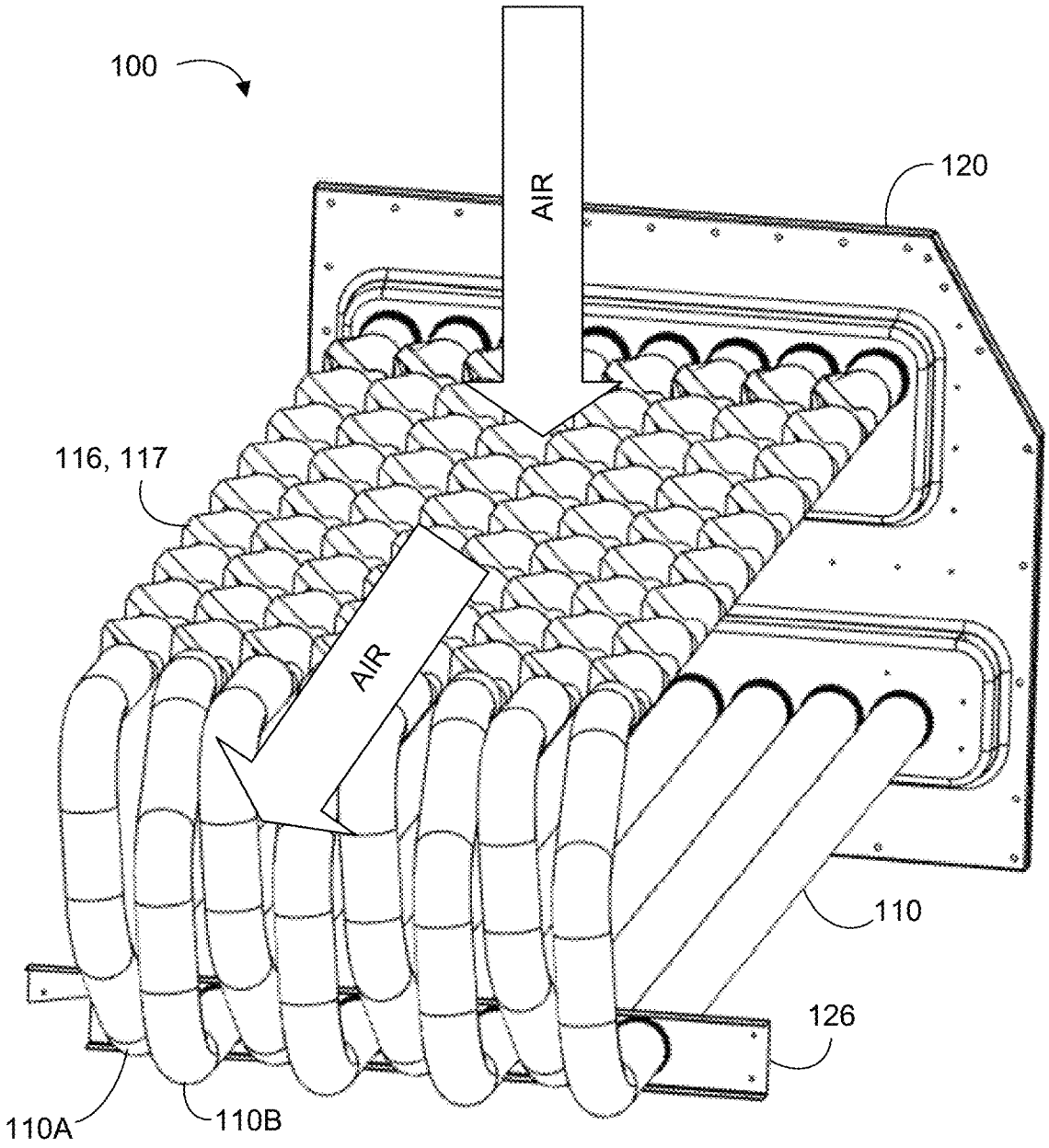
FIG. 10 illustrates a perspective view of an example heat exchanger and indicates a flow of air caused by the example heat exchanger, in accordance with the disclosed technology.

Referring to FIG. 10, the heat exchanger 100 can designed to receive airflow in a first direction (e.g., a downward direction) and redirect the airflow, or a substantial portion thereof, into a second direction that is approximately 90 degrees relative the first direction (e.g., a substantially horizontal direction). Such a configuration can be useful in, as an example, a rooftop unit (e.g., a rooftop gas furnace).

Figure 11:
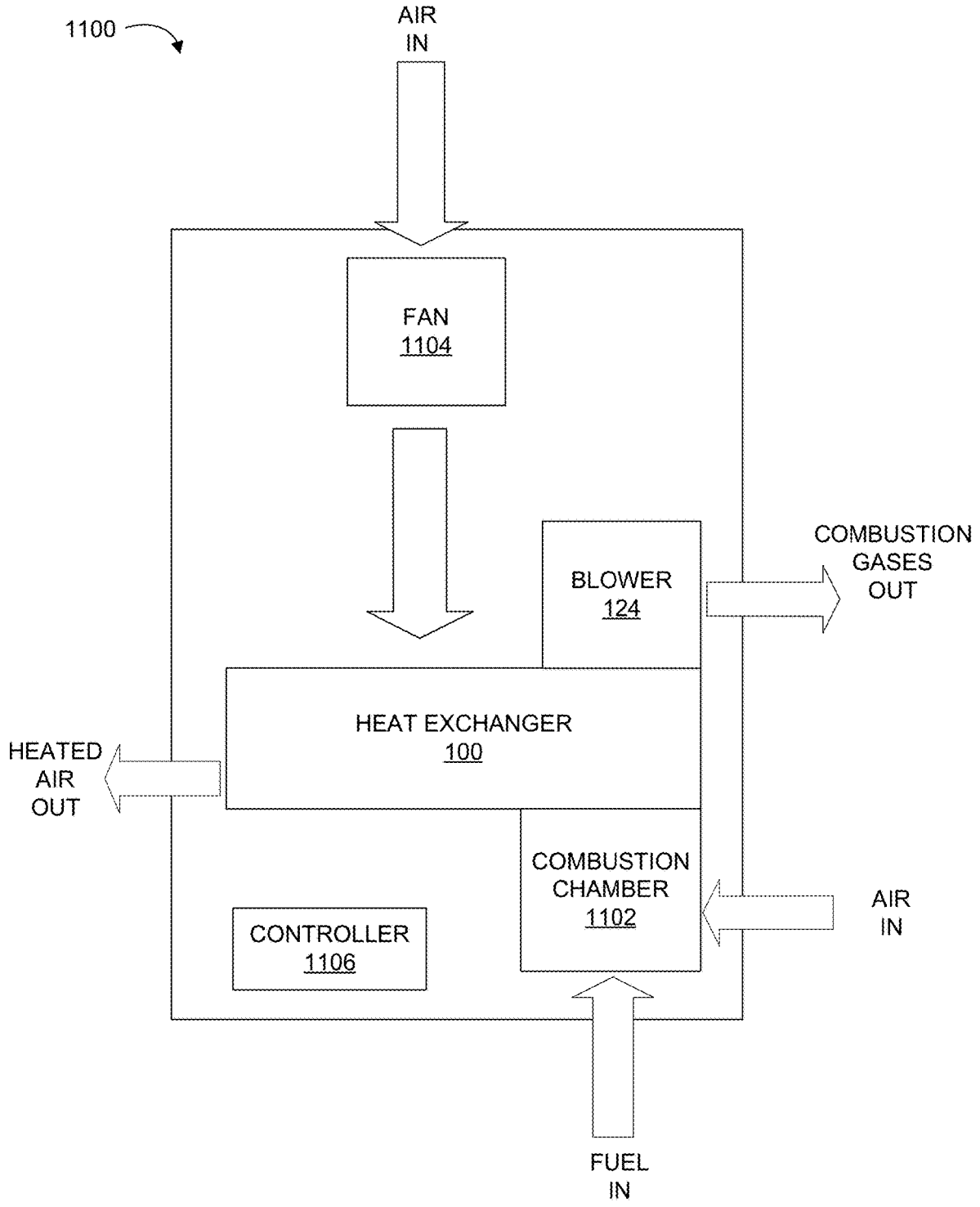
FIG. 11 illustrates a schematic diagram of an example furnace, in accordance with the disclosed technology.

FIG. 11 illustrates a schematic diagram of an example gas furnace 1100. The furnace 1100 can include a heat exchanger 100 according to the instant disclosure, a combustion chamber 1102 to provide hot combustion gases through the heat exchanger 100, and a blower (e.g. a combustion blower) to force the combustion gases through the interior of the heat exchanger 100. The furnace 1100 can include an indoor blower 1104 to force air toward the heat exchanger tubes 110 of the heat exchanger 100 such that heat can be transferred, via the heat exchanger tubes 110, from the hot combustion gases and to the flowing air. Heated air can thus be provided to a building, a portion of a building, or some other space. The furnace 1100 can include a controller 1106, which can be configured to control the blower 124, the indoor blower 1104, a fuel valve (not shown), and/or other components of the furnace 1100.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "one example," "an example," "some examples," "example embodiment," "various examples," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Further, certain methods and processes are described herein. It is contemplated that the disclosed methods and processes can include, but do not necessarily include, all steps discussed herein. That is, methods and processes in accordance with the disclosed technology can include some of the disclosed while omitting others. Moreover, methods and processes in accordance with the disclosed technology can include other steps not expressly described herein.

Throughout the specification and the claims, the following terms take at least the meanings explicitly associated herein, unless otherwise indicated. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

As used herein, unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A heat exchanger comprising:

a first heat exchanger tube having a first leg, a second leg, and a bend section, the bend section including three or more bends, each of the three or more bends of the first heat exchanger tube having a corresponding bend angle that is less than or equal to approximately 90 degrees, wherein the first leg, the second leg, and the bend section of the first heat exchanger form a first fluid flow path within the first heat exchanger tube, the first fluid flow path having:

a first straight section corresponding to the first leg of the first heat exchanger tube, a first bend of less than or equal to approximately 90 degrees, the first bend corresponding to a first bend of the three or more bends of the first heat exchanger tube, a second bend of less than or equal to approximately 90 degrees, the second bend corresponding to a second bend of the three or more bends of the first heat exchanger tube, a third bend of less than or equal to approximately 90 degrees, the third bend corresponding to a third bend of the three or more bends of the first heat exchanger tube, and a second straight section corresponding to the second leg of the first heat exchanger tube; and a second heat exchanger tube having a first leg, a second leg, and a bend section, the bend section including three or more bends, each of the three or more bends of the second heat exchanger tube having a corresponding bend angle that is less than or equal to approximately 90 degrees, wherein the first leg, the second leg, and the bend section of the second heat exchanger tube form a second fluid flow path within the second heat exchanger tube, the second fluid flow path having:

a first straight section corresponding to the first leg of the second heat exchanger tube, a first bend of less than or equal to approximately 90 degrees, the first bend corresponding to a first bend of the three or more bends of the second heat exchanger tube, a second bend of less than or equal to approximately 90 degrees, the second bend corresponding to a second bend of the three or more bends of the second heat exchanger tube, a third bend of less than or equal to approximately 90 degrees, the third bend corresponding to a third bend of the three or more bends of the second heat exchanger tube, and a second straight section corresponding to the second leg of the second heat exchanger tube.

2. The heat exchanger of claim 1, wherein the first bend of the three or more bends of the first heat exchanger tube has a bend angle of approximately 90 degrees;

the second bend of the three or more bends of the first heat exchanger tube has a first acute bend angle;

the third bend of the three or more bends of the first heat exchanger tube has a second acute bend angle;

the first bend of the three or more bends of the second heat exchanger tube has a bend angle of approximately 90 degrees;

the second bend of the three or more bends of the second heat exchanger tube has a first acute bend angle; and the third bend of the three or more bends of the second heat exchanger tube has a second acute bend angle.

3. The heat exchanger of claim 1, wherein the bend section of at least one of the first heat exchanger tube and the second heat exchanger tube includes at least one substantially straight portion.

4. The heat exchanger of claim 3, wherein:

the bend section of the first heat exchanger tube includes:

a first substantially straight portion disposed between the first bend of the three or more bends and the second bend of the three or more bends; and a second substantially straight portion disposed between the second bend of the three or more bends and a third bend of the three or more bends, and the bend section of the second heat exchanger tube includes:

a first substantially straight portion disposed between the first bend of the three or more bends and the second bend of the three or more bends; and a second substantially straight portion disposed between the second bend of the three or more bends and a third bend of the three or more bends.

5. The heat exchanger of claim 1, wherein:

the first leg of the first heat exchanger tube is located at a height that is greater than a height of the second leg of the first heat exchanger tube, and the second leg of the second heat exchanger tube is located at a height that is greater than a height of the first leg of the second heat exchanger tube.

6. The heat exchanger of claim 5, wherein fins are disposed along at least a portion of the first leg of the first heat exchanger tube and at least a portion of the second leg of the second heat exchanger tube.

7. The heat exchanger of claim 5, wherein ridges are disposed along at least a portion of the first leg of the first heat exchanger tube and at least a portion of the second leg of the second heat exchanger tube.

8. The heat exchanger of claim 1, wherein:

a length of the first leg of the first heat exchanger tube is greater than a length of the second leg of the first heat exchanger tube, and a length of the second leg of the second heat exchanger tube is greater than a length of the first leg of the second heat exchanger tube.

9. The heat exchanger of claim 1, wherein at least one of the first heat exchanger tube and the second heat exchanger tube has a non-zero incline angle with respect to horizontal when viewed from a side of the first heat exchanger tube or the second heat exchanger tube.

10. The heat exchanger of claim 9, wherein the incline angle is in a range between approximately 0.5 degree and approximately 5 degrees.

11. The heat exchanger of claim 1, wherein an incline angle of the first heat exchanger tube is different from an incline angle of the second heat exchanger tube.

12. The heat exchanger of claim 1, wherein at least one of the first heat exchanger tube and the second heat exchanger tube has a non-zero tilt angle with respect to vertical when viewed from an end of the first heat exchanger tube or the second heat exchanger tube.

13. The heat exchanger of claim 12, wherein the tilt angle is in a range between approximately 0.5 degree and approximately 10 degrees.

14. The heat exchanger of claim 12, wherein the tilt angle of the first heat exchanger tube is different from the tilt angle of the second heat exchanger tube.

15. The heat exchanger of claim 1, wherein:

the first heat exchanger tube is one of a first plurality of heat exchanger tubes, the second heat exchanger tube is one of a second plurality of heat exchanger tubes, none of the first plurality of heat exchanger tubes is adjacent to another of the first plurality of heat exchanger tubes, and none of the second plurality of heat exchanger tubes is adjacent to another of the second plurality of heat exchanger tubes.

16. The heat exchanger of claim 1, wherein:

the first heat exchanger tube is one of a first plurality of heat exchanger tubes, the second heat exchanger tube is one of a second plurality of heat exchanger tubes, and a U-bend heat exchanger tube is disposed between each of the first plurality of heat exchanger tubes and the second plurality of heat exchanger tubes such that each of the first plurality of heat exchanger tubes is adjacent to at least one U-bend heat exchanger tube and each of the second plurality of heat exchanger tubes is adjacent to at least one U-bend heat exchanger tube.

17. The heat exchanger of claim 1, wherein:

the first heat exchanger tube and the second heat exchanger tube are two of a plurality of heat exchanger tubes, and the plurality of heat exchanger tubes is configured to redirect a substantial portion of an airflow from a generally vertical direction to a generally horizontal direction.

18. The heat exchanger of claim 1, wherein the first heat exchanger tube is located at a height that is greater than a height of the second heat exchanger tube.

19. A furnace comprising the heat exchanger of claim 1, the furnace further comprising:

a combustion chamber;

a combustion blower configured to move combustion gases from the combustion chamber through the first heat exchanger tube and the second heat exchanger tube; and an indoor blower configured to move air toward the first heat exchanger tube and the second heat exchanger tube.

* * * * *